United States Patent [19]

vonBergen

[11] Patent Number: 4,507,987

[45] Date of Patent: Apr. 2, 1985

[54] WIRE FENCE STRAND SPREADER

[76] Inventor: Otto E. vonBergen, 1204 5th St., Columbus, Nebr. 68601

[21] Appl. No.: 501,064

[22] Filed: May 31, 1983

[51] Int. Cl.[3] ..... B25B 25/00

[52] U.S. Cl. ..... 81/485; 24/19; 24/505; 24/230.5 AD; 256/34; 256/37

[58] Field of Search .... 24/19, 116 R, 505, 230.5 AD, 24/129 R, 129 B, 129 C, 129 A; 256/37, 34, 35, 36; 81/3 R

[56] References Cited

U.S. PATENT DOCUMENTS

| | | | |
|---|---|---|---|
| 543,853 | 8/1895 | Davis | 256/37 |
| 1,075,769 | 10/1913 | Dall | 256/35 |
| 1,227,171 | 5/1917 | Moore | 24/230.5 AD |
| 1,368,642 | 2/1921 | Midgley | 24/230.5 AD |
| 2,370,358 | 2/1945 | Koch | 24/230.5 AD |
| 3,375,557 | 4/1968 | Parr | 24/116 R |
| 3,934,855 | 1/1976 | Patterson et al. | 24/19 |
| 4,224,721 | 9/1980 | Ohlson | 24/230.5 AD |

*Primary Examiner*—Roscoe V. Parker
*Attorney, Agent, or Firm*—Harvey B. Jacobson

[57] ABSTRACT

An elongated panel member body is provided including opposite end hooks opening toward remote ends of the body and outwardly of a first longitudinal side edge of the body. A longitudinal midportion of the body includes a transverse first finger receiving bore formed therethrough and the opposite end portions of the other longitudinal edge of the body include thumb engageable abutment surfaces facing outwardly of the body and engageable by the thumb of the user. One end of the body extends endwise outwardly beyond the corresponding hook and has one end of an elongated flexible tension member anchored relative thereto, the other end of the tension member being equipped with a hook member. One of the hooks may be engaged with a first strand of a multistrand fence, the first finger of one hand of the user may be engaged in the transverse bore formed in the body and the other hand of the user may be applied to a second adjacent strand of the fence for deflecting that strand toward the first strand while the first finger of the one hand of the user displaces the body toward the second strand and engages the second strand with the second body hook. If the spacing between adjacent fence strands is too great, the first strand of the fence may be engaged by the free end of the tension member rather than the first mentioned hook.

7 Claims, 4 Drawing Figures

WIRE FENCE STRAND SPREADER

BACKGROUND OF THE INVENTION

There are many instances when persons desire to pass through the multistrand fences such as a barbed wire fence. If a person wishing to pass through a barbed wire fence is accompanied by a second person, the second person may assist in deflecting adjacent strands of the fence in order to enable the first person to pass through and the first person may then deflect adjacent strands of the fence away from each other in order to enable the second person to pass through the fence. However, if a person desiring to pass through a barbed wire fence is not accompanied by a second person, movement through the fence between adjacent strands thereof is often difficult, if not impossible, without clothing damage or personal injury. Accordingly, a need exists for a wire fence strand spreader or deflector which may be used by a single person to facilitate his movement through a multistrand fence such as a barbed wire fence.

Examples of various forms of fence strand deflecting structures including some of the basic structural and operational features of the instant invention are disclosed in U.S. Pat. Nos. 543,853, 825,916 and 1,075,769.

BRIEF DESCRIPTION OF THE INVENTION

The strand spreader or deflector of the instant invention comprises an elongated panel-like body including opposite longitudinal side edges. The opposite ends of one of the longitudinal side edges define opposite end hooks each opening toward the other end of the body and outwardly of the corresponding longitudinal edge. An intermediate portion of the body includes a transverse first finger receiving transverse bore formed therethrough and one end of the body projects endwise outwardly beyond the corresponding hook and has one end of an elongated tension member anchored relative thereto with the other end of the tension member including a hook member.

The fence strand deflector may have one of the hooks engaged with a first strand of a fence and the other hook engaged with a second adjacent strand of the fence with the engaged portion of the fence strand deflected toward each other. If the spacing between adjacent strands is too great for the deflected portions of the strands to be received in the body end hook, one of the strands may be engaged by the tension member and/or the hook member carried by the free end of the tension member.

The main object of this invention is to provide an apparatus by which adjacent strands of a multistrand fence may be deflected toward each other and anchored in deflected positions.

Another object of this invention is to provide an apparatus in accordance with the preceding object and constructed in a manner whereby the apparatus may compensate for different spacings between adjacent fence strands.

Yet another important object of this invention is to provide an apparatus including means by which the apparatus itself may be engaged by the first finger of the user in a non-slip manner in order to prevent accidental release of a deflected strand while the apparatus is being manipulated to engage an adjacent fence strand.

Another very important object of this invention is to provide a fence strand spreader or deflecting structure constructed in a manner enabling it to be used on different types of multistrand fences.

A final object of this invention to be specifically enumerated herein is to provide a fence strand spreader or deflector in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a multistrand fence illustrating the manner in which the strand spreader or deflector may be used to create an opening through a multistrand fence by which a person may pass from one side of the fence to the other, the strand deflector being in use to deflect a pair of strands toward an intermediate strand disposed between;

DETAILED DESCRIPTION OF THE INVENTION

Figure 1:
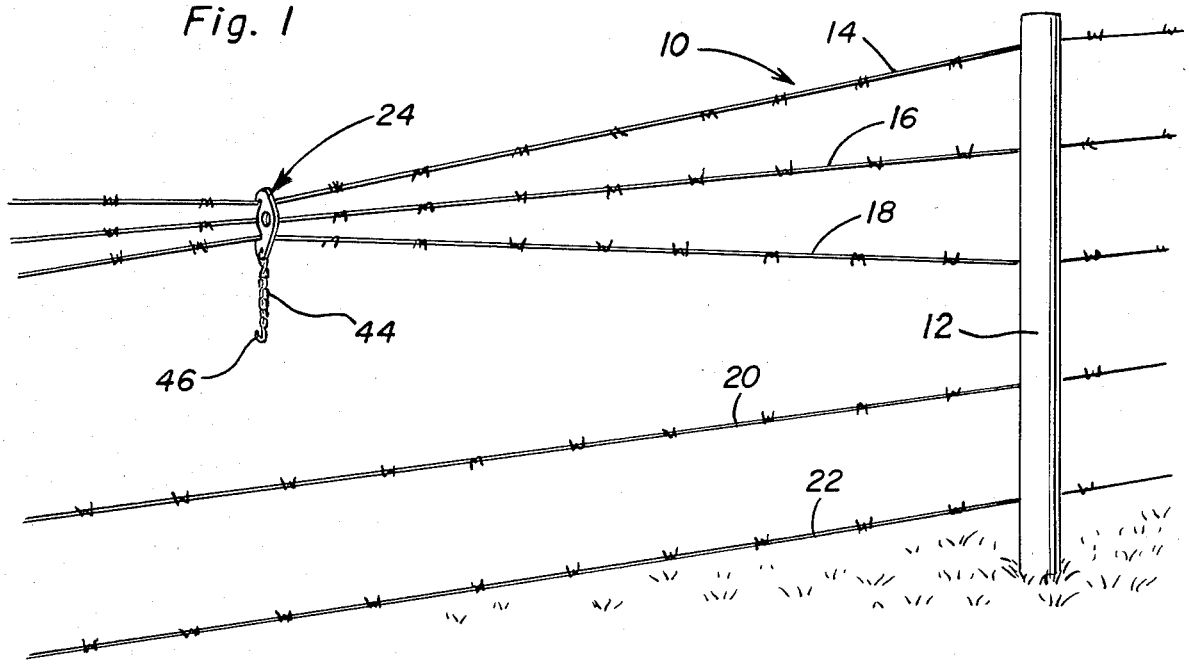

Referring now more specifically to the drawings, the numeral 10 generally designates a typical form of multistrand fence including a line post 12 and five vertically spaced horizontal barbed wire strands 14, 16, 18, 20 and 22. As may be seen in the extreme right-hand portion of FIG. 1, the strands 14–22 are closely spaced and movement therebetween without deflecting two of the strands away from each other would be substantially impossible.

The wire fence strand spreader or deflector of the instant invention is referred to in general by the reference numeral 24 and includes an elongated panel-shaped body 26 defining first and second longitudinal edges 28 and 29. The longitudinal edge 28 includes a pair of recesses 30 and 32 formed in its opposite end portions defining hooks 34 and 36 each opening toward the remote end of the body and outwardly of the marginal edge 28. One end 38 of the body 26 projects endwise outwardly beyond the corresponding hook 36 and is provided with a transverse aperture 40 through which one link 42 of a link chain section 44 is secured. The opposite end of the link chain section 44 includes a hook 46 thereon.

The longitudinal edge 29 of the body 26 includes oppositely inclined opposite end portions 48 and 50 which define abutment surfaces for a purpose to be hereinafter more fully set forth.

Figure 2:
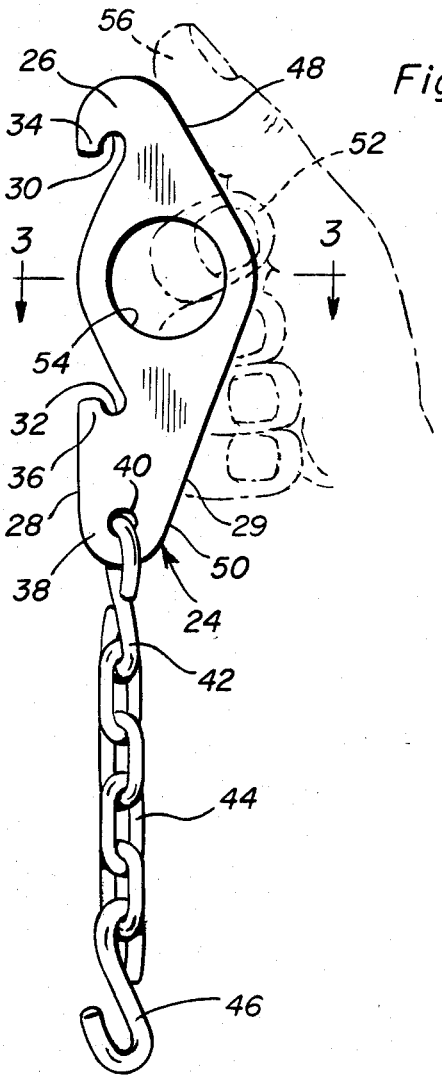
FIG. 2 is a side elevational view of the strand spreader or deflector.
Figure 3:
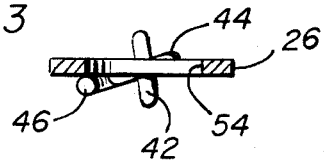
FIG. 3 is a horizontal sectional view taken substantially upon the plane indicated by the section line 3—3 of FIG. 2.

With attention now invited more specifically to FIGS. 1 and 2 of the drawings, when it is desired to deflect the strands 14 and 18 toward the strand 16, the strand spreader or deflector 24 is held in one hand of the user with the user's first finger 52 extending through a transverse opening 54 formed in the body 26 centrally intermediate the hooks 34 and 36. After being thus supported in one hand, the user may engage the hook 30 with the top strand 14 and pulled downwardly upon the body 26 by his finger and upwardly on the strand 18 with his other hand until the lower hook 36 may be engaged with the strand 18. Conversely, the strand spreader or deflector 24 may be engaged in the manner illustrated in FIG. 2 of one hand with the finger 52 received through the opening 54 and the user's thumb 56 engaged with the abutment surface 48. Then, the strand 18 may be engaged by the hook 36 and the user's hand may pull upwardly on the strand spreader or deflector 24 by his first finger 52 and the upper strand 14 may be downwardly deflected by the other hand of the user until the thumb 56 may exert sufficient pressure on the upper end of the body 36 to cause the hook 34 to engage the top strand 14. In this manner, an opening between the strands 18 and 20 of sufficient height is provided for the user of strand spreader or deflector 24 to pass through the fence 10.

Figure 4:
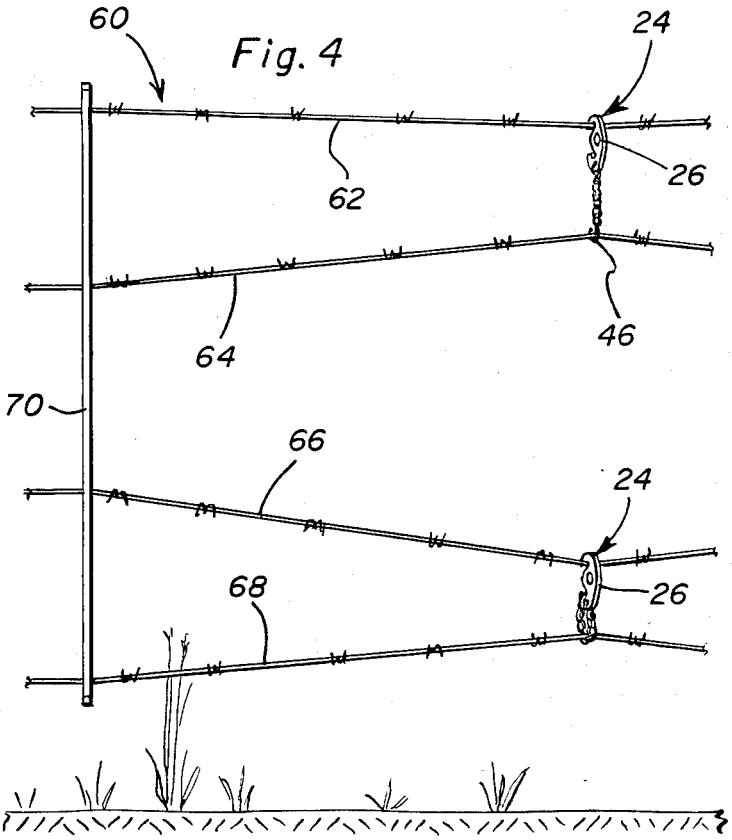
FIG. 4 is an elevational view illustrating the manner in which a pair of strand spreaders or deflectors may be used to deflect adjacent strands of a fence toward each other.

With attention now invited more specifically to FIG. 4 of the drawings, there may be seen a second fence referred to in general by the reference numeral 60 and wherein the fence includes only four strands 62, 64, 66 and 68 and a spreader bar 70 is anchored between the strands 62–68 intermediate adjacent posts (not shown) of the fence 60. In this instance, it may become necessary to use a pair of the strand spreaders or deflectors 24, inasmuch as deflection of the strands 62–68 is more difficult due to the spreader 70. In any event, an upper deflector 24 may have its hook member 46 engaged with the strand 64 and the deflector 24 may have an upward pull exerted thereon to enable the strand 62 to be engaged by the hook 34. If this does not provide sufficient room between the strands 64 and 66, a second deflector 24 may be engaged with the strands 66 and 68. If it is possible, the tension member 64 is looped about the strand 68 with the anchor members 64 engaged by the hook 36. Then, an upward pull is exerted on the deflector 24 and the upper hook 34 thereof may be engaged with the strand 66 after the latter has been downwardly deflected toward the strand 68. In this manner, a pair of deflectors 24 may be utilized to provide an opening of sufficient height between the strands 64 and 66 to enable a person to pass through the fence 60.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A wire fence strand spreader including an elongated body defining opposite end hooks opening longitudinally of said body toward each other in directions inclined slightly outwardly of one side of said body, a longitudinal mid-portion of said body spaced between said hooks including an opening formed transversely therethrough and in which a user's first finger may be received to provide an anti-slip anchoring of said finger to said body, the side of said body opposite said one side including oppositely inclined opposite end abutment surfaces extending longitudinally therealong each, selectively, engageable by the thumb of a hand having the first finger thereof engaged through said opening, said abutment surfaces defining an included angle opening toward said opening, said hooks being spaced apart longitudinally of said body on remote sides of said opening.

2. The spreader of claim 1 wherein said body comprises a panel member and said first and second longitudinal sides of said body comprise opposite longitudinal edges thereof.

3. The spreader of claim 2 wherein said opening extends in a direction through said body disposed generally normal to the medial plane of said panel member.

4. A wire fence strand spreader including an elongated body defining opposite end hooks opening toward remote ends of said body and outwardly of a first longitudinal side of said body, a longitudinal mid-portion of said body including anchor structure engageable by a user's finger to provide an anti-slip anchoring of said finger to said body, the opposite end portions of a second side of said body opposite said first side including thumb engageable abutment surfaces facing outwardly thereof and engageable by the thumb of the user, one end of said body extending endwise outwardly beyond the corresponding hook and having one end of an elongated flexible tension member anchored relative thereto and the other end of said tension member being equipped with a hook member.

5. The spreader of claim 4 wherein said anchor structure includes an opening formed transversely through said body in which the user's first finger may be received.

6. The spreader of claim 5 wherein said body comprises a panel member and said first and second longitudinal sides of said body comprise opposite longitudinal edges thereof.

7. The spreader of claim 6 wherein said opening extends in a direction through said body disposed generally normally to th medial plane of said panel member.

* * * * *